US008733105B2

(12) United States Patent
Toon

(10) Patent No.: US 8,733,105 B2
(45) Date of Patent: May 27, 2014

(54) FUEL INJECTOR

(75) Inventor: Ian James Toon, Leicester (GB)

(73) Assignee: Rolls-Royce PLC (GB)

( * ) Notice: Subject to any disclaimer, the term of this patent is extended or adjusted under 35 U.S.C. 154(b) by 1144 days.

(21) Appl. No.: 12/573,234

(22) Filed: Oct. 5, 2009

(65) Prior Publication Data

US 2010/0115956 A1 May 13, 2010

(30) Foreign Application Priority Data

Nov. 11, 2008 (GB) ..... 0820560.1

(51) Int. Cl.
*F02C 1/00* (2006.01)

(52) U.S. Cl.
USPC ..... 60/742

(58) Field of Classification Search
USPC ..... 60/737, 740, 742, 743, 748; 239/399–405
See application file for complete search history.

(56) References Cited

U.S. PATENT DOCUMENTS

| | | | | |
|---|---|---|---|---|
| 3,638,865 | A | 2/1972 | McEneny et al. | |
| 3,764,071 | A | 10/1973 | Carlisle | |
| 4,373,325 | A | 2/1983 | Shekleton | |
| 5,323,614 | A | 6/1994 | Tsukahara et al. | |
| 6,622,488 | B2 * | 9/2003 | Mansour et al. | 60/740 |
| 6,865,889 | B2 | 3/2005 | Mancini et al. | |
| 6,959,535 | B2 | 11/2005 | Mancini et al. | |
| 6,986,255 | B2 | 1/2006 | Smith et al. | |
| 7,090,205 | B2 | 8/2006 | Oda et al. | |
| 2005/0097889 | A1 * | 5/2005 | Pilatis et al. | 60/743 |
| 2007/0163263 | A1 * | 7/2007 | Thomson | 60/773 |
| 2008/0178598 | A1 | 7/2008 | Commaret et al. | |

FOREIGN PATENT DOCUMENTS

| | | |
|---|---|---|
| EP | 1331441 | 7/2003 |
| EP | 1413830 | 4/2004 |
| EP | 1750056 A8 | 2/2007 |
| GB | 2088037 | 6/1982 |
| GB | 2439097 A | 6/2006 |
| GB | 2445113 | 6/2008 |

OTHER PUBLICATIONS

European Search Report dated Dec. 6, 2012 from corresponding EP Application No. 09252041 and European Search Report dated Dec. 7, 2012 from corresponding EP Application No. 09251786.

* cited by examiner

*Primary Examiner* — Phutthiwat Wongwian
(74) *Attorney, Agent, or Firm* — McCormick, Paulding & Huber LLP

(57) ABSTRACT

A fuel injector for a fuel spray nozzle of a gas turbine engine combustor is provided. The fuel injector has an annular flow passage which conveys fuel to a prefilming lip at an end of the flow passage. The fuel injector also has plurality of fuel distributor slots which are circumferentially spaced around and in fluid communication with the other end of the flow passage to deliver respective fuel streams into the flow passage. The slots are configured so that the fuel streams enter the flow passage at a swirl angle of at least 80° relative to the axis of the flow passage.

17 Claims, 5 Drawing Sheets

FUEL INJECTOR

CROSS REFERENCE TO RELATED APPLICATION

This application is entitled to the benefit of British Patent Application No. GB 0820560.1, filed on Nov. 11, 2008.

FIELD OF THE INVENTION

The present invention relates to a fuel injector for a fuel spray nozzle of a gas turbine engine combustor.

BACKGROUND OF THE INVENTION

Fuel injection systems deliver fuel to the combustion chamber of an engine, where the fuel is mixed with air before combustion. One form of fuel injection system known in the art is a fuel spray nozzle. Fuel spray nozzles atomise the fuel to ensure its rapid evaporation and burning when mixed with air.

An airblast atomiser nozzle is a type of fuel spray nozzle in which fuel delivered to the combustion chamber by a fuel injector is aerated by swirlers to ensure rapid mixing of fuel and air, and to create a finely atomised fuel spray.

Efficient mixing of air and fuel results in higher combustion rates. It also reduces unburnt hydrocarbons and exhaust smoke (which result from incompletely combusted fuel) emitted from the combustion chamber.

Additionally, "lean burn combustion" is being developed as a way of operating at relatively low flame temperatures. The lower temperatures significantly reduce NOx emissions, but can necessitate the use of a pilot and mains fuel nozzle to avoid lean extinction at low engine powers.

FIG. 1 shows a schematic view of a fuel injection nozzle 10 which, in use, would be mounted on the upstream wall of a combustion chamber 100.

The fuel injection nozzle 10 has a central axis 11, and is in general circularly symmetrical about this axis. A pilot fuel injector 12 is centred on the axis, and is surrounded by a pilot swirler 13. A mains airblast fuel injector 14 is concentrically located about the pilot fuel injector 12, with inner and outer mains swirlers 15 and 16 positioned radially inward and outward thereof.

The mains airblast fuel injector has an annular flow passage or gallery 17. Circumferentially spaced fuel distributor slots 19 deliver fuel to the fore end of the gallery. The fuel is then conveyed along the gallery to a prefilming lip 18 formed at the aft end of the gallery. An annular film of liquid fuel forms on the lip, and is entrained in and atomised by the much more rapidly moving and swirling air streams produced by inner mains swirler 15 and outer mains swirler 16.

To achieve lean burn, the system not only incorporates pilot and mains fuel injectors, but also requires a relatively large amount of combustion air. To realise the low combustion temperatures the fuel must be well mixed with the air prior to combustion, hence creating uniform low flame temperatures. Non-uniform mixing prior to combustion can result in locally high combustion temperatures, and hence no reduction in NOx emissions. Low combustion efficiency in the lower temperature areas increases the engine's specific fuel consumption, and emissions of carbon monoxide and unburnt fuel.

Thus, it is desirable to improve the design of fuel injectors to achieve more uniform fuel-air mixing.

SUMMARY OF THE INVENTION

A first aspect of the invention provides a fuel injector for a fuel spray nozzle of a gas turbine engine combustor, the fuel injector having:

an annular flow passage (or gallery) which conveys fuel to a prefilming lip at an end of the flow passage, and a plurality of fuel distributor slots which are circumferentially spaced around and in fluid communication with the other end of the flow passage to deliver respective fuel streams into the flow passage;

wherein the slots are configured so that the fuel streams enter the flow passage at a swirl angle of at least 80° relative to the axis of the flow passage.

By "swirl angle" is meant the angle between the axis of the flow passage (which is typically coincident with the central axis of a fuel spray nozzle, of which the fuel injector is an element) and the direction of flow of a fuel stream as it enters the flow passage.

Advantageously, by swirling the fuel streams at a high swirl angle, the fuel streams can be merged earlier in the flow passage, producing a more circumferentially uniform fuel mass flow rate from the passage onto the prefilming lip. Indeed, preferably, the flow passage is configured so that the fuel streams merge in the flow passage to provide a circumferentially substantially uniform fuel mass flow at the prefilming lip.

A further advantage of the high swirl angle is that a shortened flow passage can be adopted, allowing a more compact and lighter fuel injector to be produced.

Preferably, in the circumferential direction, the ratio of the slot pitch (i.e. the distance between the centres of neighbouring slots) to the slot width at the narrowest point of a slot is at most 40. Preferably the ratio is at least 5, and more preferably at least 20.

Preferably, the ratio of the annular flow passage length in the axial direction to the slot width in the circumferential direction at the narrowest point of a slot is at most 20, and more preferably at most 10 or 3.

Preferably, the fuel distributor slots open to an upstream wall of the annular flow passage, the slots being further configured so that on entry into the flow passage the fuel streams retain contact with the upstream wall. Typically, the upstream wall is perpendicular to the axis of the flow passage. In this case, by retaining contact with the wall, at least the edges of the fuel streams have 90° swirl angles. However, other arrangements are possible. For example, the upstream wall may have a serrated, rippled or saw-tooth profile in the circumferential direction such that portions of the wall at the exits of the slots are at an angle of less than 90° (but at least 80°) to the axis of the flow passage, whereby the fuel streams can enter the flow passage at a corresponding swirl angle and still retain contact with the wall.

By keeping the fuel streams in contact with the upstream wall of the flow passage, rapid merging of the flow streams can be achieved. Further, two phase flow in the passage can be reduced or eliminated.

To retain contact between the fuel streams and the upstream wall of the flow passage, each slot may have:

a first section in which a pressure surface and an opposing suction surface constrain the respective flow stream to flow at a predetermined angle relative to the axis of the flow passage, and a second section in which the suction surface is blended to said upstream wall so that the Coandă effect causes the respective flow stream to retain contact with the upstream wall.

The predetermined angle may be at least 70°. The predetermined angle may be at most 85°.

Preferably, the pressure surface is absent from the second section. This can help to discourage expansion of the fuel stream, which might otherwise tend to counter the Coandă effect.

The flow passage may be a cylindrical annulus. Alternatively, the flow passage may be a frustoconical annulus which expands from the fuel distributor slots to the prefilming lip. Configuring the fuel distributor slots, so that the fuel streams merge early in the flow passage, allows relatively simple passage geometries to be adopted. Advantageously, such geometries can allow fuel to drain fully from the passage when the flow of fuel is stopped. This helps to prevent trapped fuel coking in and blocking the passage when the main fuel is stopped (staged) below full engine power and the engine operates with pilot fuel only.

Preferably, the fuel injector is an airblast fuel injector.

A further aspect of the invention provides a fuel spray nozzle having the fuel injector according to the previous aspect. For example, the fuel injector may be a mains fuel injector, with the nozzle further having a radially inwards pilot fuel injector.

A further aspect of the invention provides a gas turbine engine combustor having the fuel spray nozzle of the previous aspect.

DETAILED DESCRIPTION OF THE PREFERRED EMBODIMENTS

Before discussing the invention it is helpful to provide more detail of other fuel injector arrangements.

Figure 1:
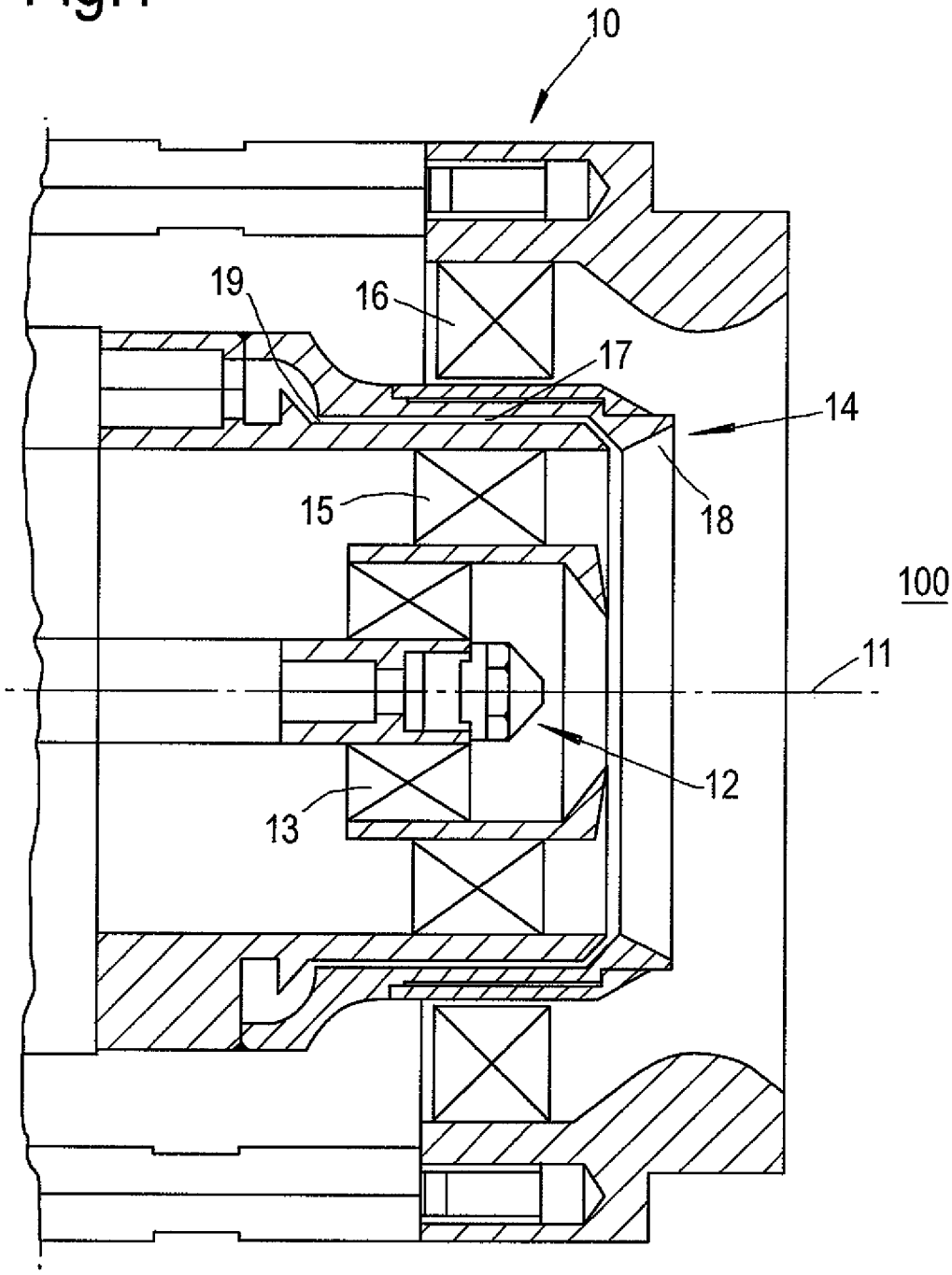
FIG. 1 shows a schematic longitudinal cross-sectional view of a fuel injection nozzle.

The mains fuel injector of a pilot and mains fuel nozzle passes typically 85% of the fuel and air, and is thus the dominant emissions source. In a fuel injection nozzle such as that shown in FIG. 1, a relatively large diameter mains fuel prefilming lip, and correspondingly large annular flow passage (gallery), is generally needed to deliver such a high percentage of the fuel and air. The large diameter can result in a correspondingly wide spacing of the fuel distributer slots which deliver fuel to the fore end of the gallery. For example, the fuel slot pitch to width ratio in the circumferential direction may be 30:1. In the gallery, the fuel streams delivered by the distributor slots spread sideways. Desirably, the spread should be enough to fill the annulus circumferentially, and hence create a circumferentially uniform mass flow rate onto the prefilming lip, as required for low emissions.

Figure 2:
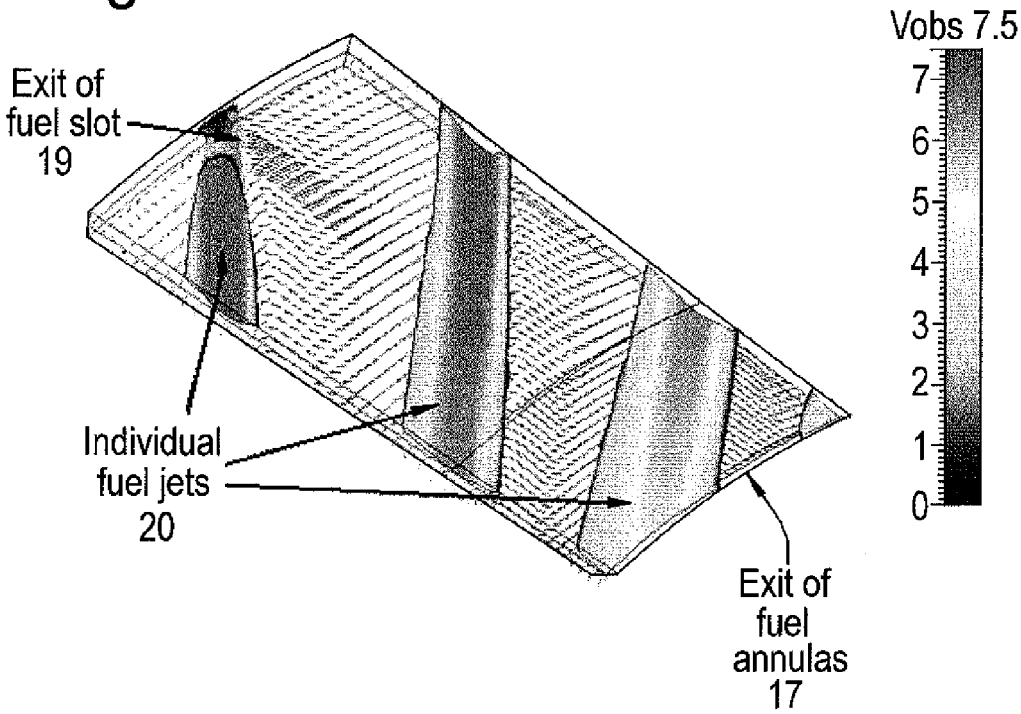
FIG. 2 shows the fuel stream as predicted by computational fluid dynamics (CFD) for a 20° sector of the gallery of the mains injector of a nozzle such as that shown in FIG. 1, the gallery having at its fore end the outlet of one of eighteen equally circumferentially spaced fuel distributor slots.
Figure 3:
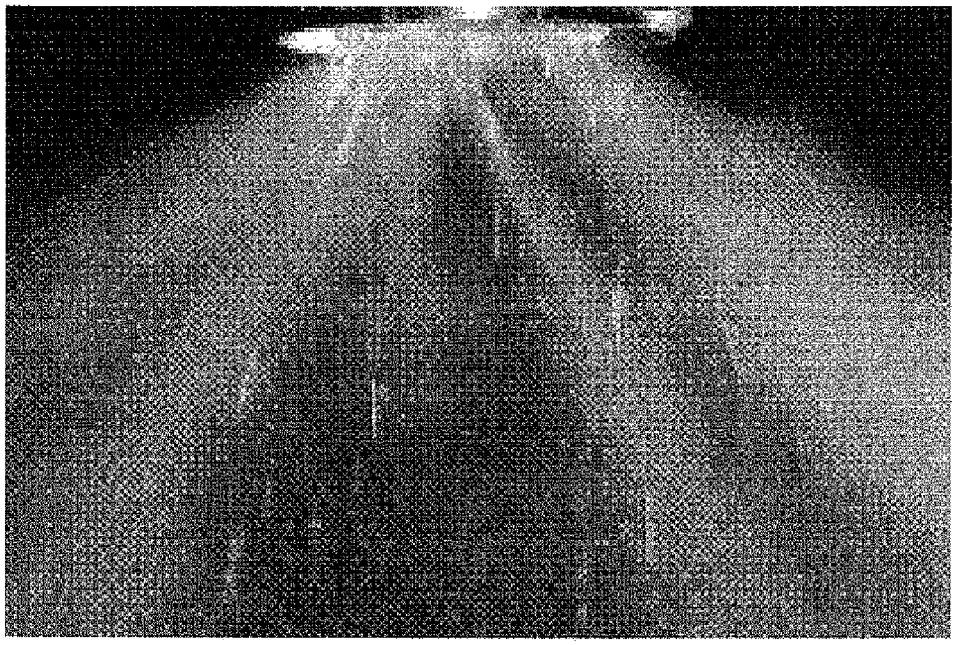
FIG. 3 shows non-uniform fuel spray from a prefilming lip of a mains injector.

FIG. 2 shows the fuel stream spread as predicted by computational fluid dynamics (CFD) for a 20° sector of a gallery 17 having at its fore end the outlet of one of eighteen equally circumferentially spaced fuel distributor slots 19. Within the gallery there is two phase flow of fuel and air. The fuel stream 20 spreads with a divergence of about 2° at either side. However, by the aft end of the gallery, due to the wide spacing of the slots around the gallery, the streams have not spread sufficiently to fill the gallery. FIG. 3 shows the non-uniform fuel spray from the prefilming lip which undesirably results.

Figure 4:
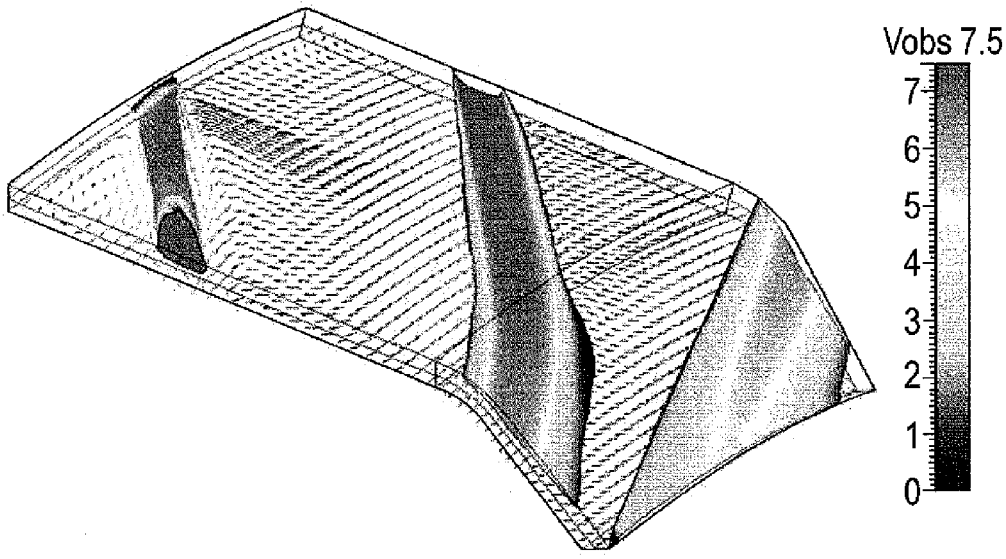
FIG. 4 shows the fuel stream predicted by CFD for a modified gallery relative to that of FIG. 2, the modified gallery having a change of direction forcing the fuel stream to impinge on a wall of the gallery.

One option is to modify the shape of the gallery to encourage better circumferential spread of the fuel streams. FIG. 4 shows the fuel stream predicted by CFD for a modified gallery which has a change of direction forcing the stream 20 to impinge on a wall of the gallery. The impingement causes the stream to spread further than in the unmodified gallery of FIG. 2. However, a uniform circumferential mass flow rate at the gallery exit is still not achieved.

Possible further modifications to achieve uniform circumferential mass flow are (a) to lengthen the gallery between the fuel distributor slots and the prefilming lip and (b) to adopt a more complicated gallery geometry. However, these add cost, size and weight.

Further, as a result of engine staging operations the mains fuel is not always flowing. That is, to achieve high combustion efficiencies, the nozzle sometimes flows fuel through the pilot injector only. In this case, the fuel in the mains gallery should drain away completely to prevent stagnant fuel thermally degrading in the gallery and forming coke. Successive mains staging events (which can occur many times per flight) can cause such coke deposits to grow, until eventually the gallery may become partially or completely blocked. As incomplete mains fuel draining tends to occur in more complicated gallery geometries, this mitigates against the adoption of such geometries. Stagnant mains fuel upstream of the gallery remains cooler due to the closer proximity of pilot fuel passages, and coking is therefore not such a problem in these locations.

The two phase flow in the mains gallery illustrated in FIGS. 2 and 4, even if eliminated by the time the fuel reaches the prefilming lip, can itself lead to fuel coking. This is because the gallery walls are only cooled by the mains fuel. Consequently those portions of the walls that are not wetted by the main fuel will be hotter than the wetted portions. In some circumstances, the wall temperature at the edge of a fuel stream can be high enough to break the fuel down to coke, and hence gradually block the gallery.

Figure 5:
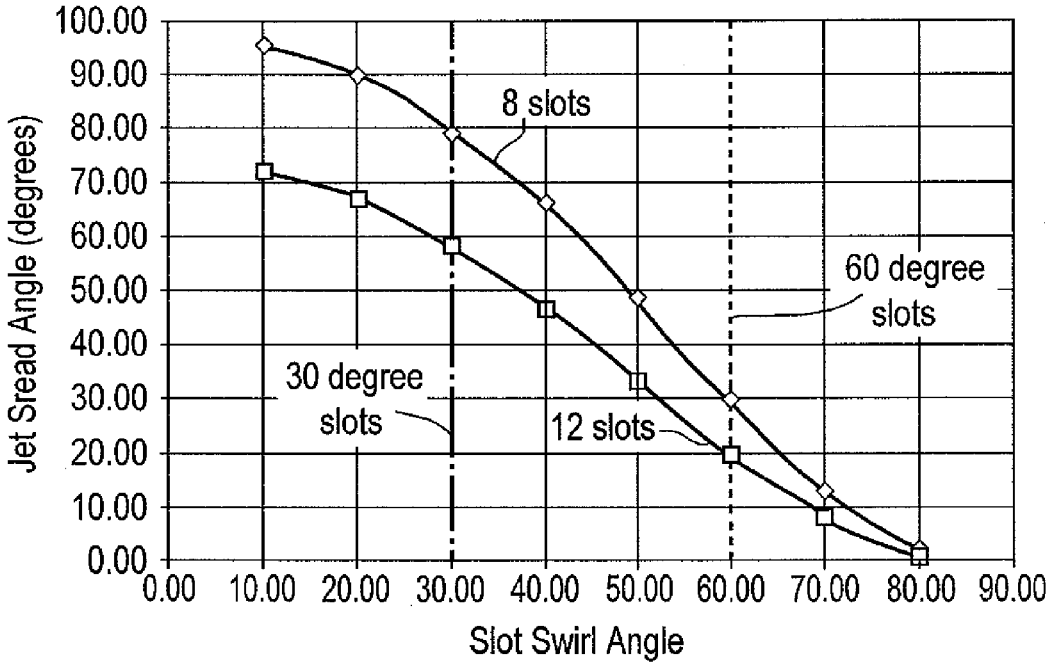
FIG. 5 shows the calculated divergence angle between the two sides of a fuel stream required to cause adjacent streams to meet at the exit from a gallery of a given axial length plotted against the swirl angle of the fuel stream.
Figure 6:
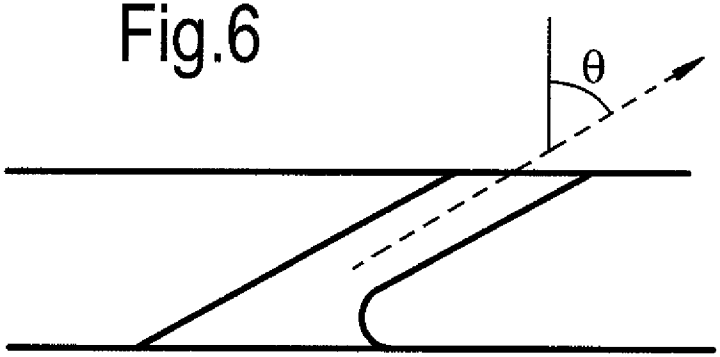
FIG. 6 is a schematic plan view of a typical conventional fuel distributor slot.

Thus, according to the present invention, a different approach is taken to encourage the fuel streams in the mains gallery to provide a uniform circumferential mass flow rate at the gallery exit. Trigonometric calculations using a typical fuel gallery geometry show that, for a gallery and fuel slot arrangement as shown in FIG. 2, in which each fuel stream diverges by about 2° at either side, swirling the fuel streams by 80° degrees or more can cause the streams to meet at the gallery exit. For example, FIG. 5 shows the calculated divergence angle between each side of the fuel stream required to cause the streams to meet at the exit from the gallery plotted against the swirl angle of the fuel stream produced by the distributor slot. One plot in FIG. 5 is for a set of calculations in which there are eight equally spaced slots, and the other plot is for a set of calculations in which there are twelve equally spaced slots. In both cases, however, the calculations show that a swirl angle of about 80° degrees or more is needed to cause the streams to meet. In contrast, typical conventional fuel distributor slots, as illustrated in FIG. 6, produce swirl angles of only about 30° degrees or 60° degrees. The dashed arrow indicates the direction of the fuel stream flowing from the slot into the gallery. The swirl angle is indicated θ.

Although, generating a higher swirl angle can cause the fuel streams to meet in the gallery, which is an improvement over the fuel flows illustrated in FIGS. 2 and 4, there may still be significant variation in fuel mass flow rate between the centrelines of the streams and the edges of the streams. Also it is desirable to eliminate two phase flow early in the gallery. Thus preferably 90° of swirl is generated in at least part of each flow stream to encourage the fuel streams to meet as early as possible in the gallery.

Figure 7A:
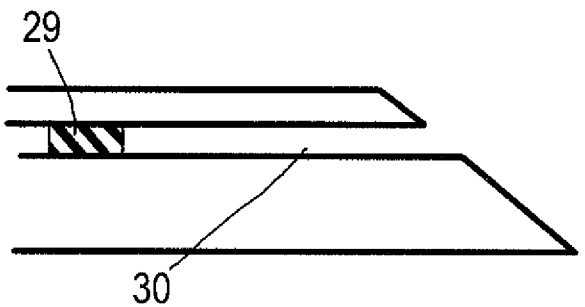
FIG. 7 shows longitudinal cross-sections through the bottom parts of mains fuel injectors having respectively (a) a parallel-walled cylindrical gallery and (b) an expanding frustoconical gallery.
Figure 7B:
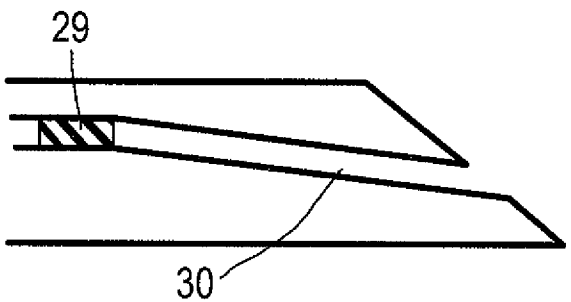

90° swirl allows the individual streams to merge early and flow together for a significant distance in the gallery, allowing the fuel mass flow rate to become circumferentially uniform by the time it reaches the gallery exit, and hence to provide a circumferentially uniform mass flow onto the prefilming lip. 90° swirl can also eliminate two phase flow and hence the hot walls that can cause fuel coking. It also does not require a complex geometry for the gallery. Indeed, only a relatively short gallery may be needed, as shown in FIGS. 7(*a*) and (*b*), which are longitudinal cross-sections through the bottom parts of respective mains fuel injectors. In FIG. 7(*a*), fuel distributor slot 29 outlets to a parallel-walled cylindrical gallery 30. In FIG. 7(*b*), fuel distributor slot 29 outlets to an expanding frustoconical gallery 30. Such galleries can completely eliminate the coking of trapped fuel during staging.

Figure 8:
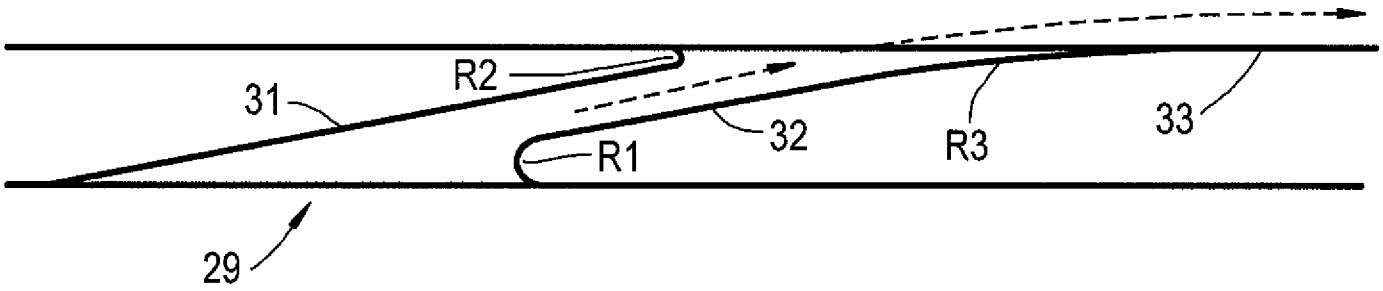
FIG. 8 is a schematic plan view of a fuel distributor slot having a geometry for producing 90° swirl.

A fuel distributor slot 29 having a geometry for producing 90° swirl is shown in FIG. 8. The slot has a pressure surface 31 and a suction surface 32. At the inlet to the slot the pressure surface makes an angle of typically between 70° and 85° relative to the axial direction of the fuel nozzle. This angle is maintained by the pressure surface into a central section of the slot. At the inlet to the slot, the suction surface has a radius R1. Following that, in the central section, the suction surface adopts the same angle to the axial direction of the slot as the pressure surface, i.e. the central section is parallel-walled. The radius R1 helps prevent flow separation at the inlet, while the parallel-walled central section promotes a uniform flow velocity at a predetermined angle within the slot parallel to the pressure and suction surfaces. The length of the parallel-walled central section is typically between one and three times the slot width in that section.

The following section of the slot 29 provides an outlet to the gallery 30 at the upstream wall 33 of the gallery. At the outlet, the pressure surface 31 has a relatively small radius R2. The suction surface 32, on the other hand, has a radius R3 which blends to the upstream wall over a significantly longer distance. The uniform flow velocity produced by the central section of the slot encourages adherence of the flow to the radius R3 of the suction surface. Further, the flow adheres to the radius R3 by the Coandă effect, and hence as the suction surface blends to the upstream wall the edge of the fuel stream contacting the wall achieves 90° of swirl.

To encourage the fuel stream to retain contact with the upstream wall 33, the pressure surface 31 does not extend to oppose R3. Further R3 should be sufficiently large. Thus the pressure surface has a relatively small blend radius R2 to the upstream wall. Indeed, the radius R2 could be replaced by a square end that achieves a similar length reduction in the pressure surface. Preferably, R3 starts on the suction surface 32 at at least 0.5 slot widths downstream of the end of the pressure surface to ensure that the fuel flow is not diffusing (expanding) when it starts to flow around R3, as such diffusion would oppose the flow adhering to R3.

With at least the edge of the fuel stream exhibiting 90° of swirl into the gallery, there is rapid convergence of the fuel streams and a relatively uniform circumferential fuel flow rate at the gallery exit to the prefilming lip. Indeed, it may be possible to reduce the length of the gallery while maintaining the uniform flow. This simplifies manufacture of the injector, and promotes complete drainage of the gallery when the flow of mains fuel is staged.

Figure 9:
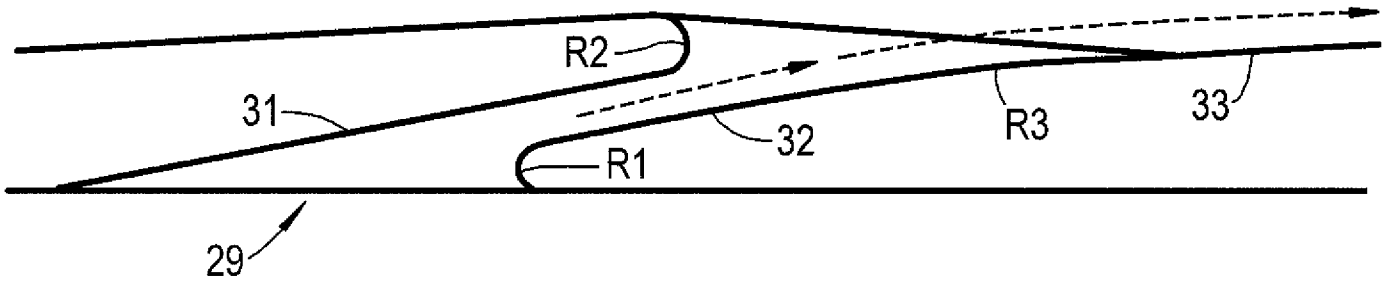
FIG. 9 is a schematic plan view of a fuel distributor slot having a geometry for producing less than 90° swirl.

FIG. 9 is a schematic plan view of a fuel distributor slot having a geometry for producing less than 90° swirl. The same reference numbers indicate features equivalent to those indicated in FIG. 8. In the geometry of FIG. 9, the upstream wall 33 of the gallery has a serrated, rippled or saw-tooth profile in the circumferential direction. The suction surface 32 blends to a portion of upstream wall which is angled at less than 90° (but at least) 80° to the axis of the gallery. However, the large size of blend radius R3 still causes the flow to adhere to the radius R3 by the Coandă effect and thence to the upstream wall 33.

Thus, the edge of the fuel stream exhibits less 90° of swirl into the gallery. However the spreading of the stream can still cause it to converge with adjacent streams to provide relatively uniform circumferential fuel flow.

To summarize, the 90° of swirl at the fuel distributor slot exit can achieve the following:

elimination of two phase flow in the uncooled gallery. Development of regions of stagnant air in the gallery and corresponding high gallery wall temperatures can thus be avoided, which in turn prevents coking of fuel on the hot walls.

circumferentially uniform fuel mass flow exiting the gallery onto the prefilming lip, which reduces emissions in lean burn combustors.

circumferentially uniform fuel mass at a relatively short distance from the outlets of the distributor slots, which allows the gallery to be shortened, facilitating a compact and light mains injector.

allows adoption of a simple gallery geometry that does not trap fuel when the mains fuel stops flowing. This eliminates gallery blockage due to coking of trapped fuel after mains staging events, thereby maintaining combustion efficiency during engine operation.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention as claimed.

What is claimed is:

1. A fuel injector for a fuel spray nozzle of a gas turbine engine combustor, the fuel injector comprising:

an annular flow passage which conveys fuel to a prefilming lip at a downstream end of the annular flow passage, and a plurality of fuel distributor slots which are circumferentially spaced around and in fluid communication with an upstream end of the annular flow passage to deliver respective fuel streams into the annular flow passage;

wherein the plurality of fuel distributor slots are configured to open onto an upstream wall at the upstream end of the annular flow passage at a swirl angle of at least 80° but not more than 90° from the downstream direction of the central axis of the annular flow passage.

2. A fuel injector according to claim 1, wherein the annular flow passage is configured so that the fuel streams merge in the annular flow passage to provide a circumferentially substantially uniform fuel mass flow at the prefilming lip.

3. A fuel injector according to claim 1, wherein the fuel distributor slots are configured so that on entry into the annular flow passage the fuel streams retain contact with the upstream wall.

4. A fuel injector according to claim 3, wherein each fuel distributor slot further comprises:

a first section in which a pressure surface and an opposing suction surface constrain the respective flow stream to flow at a predetermined angle relative to the axis of the annular flow passage, and a second section in which the suction surface is smoothly continued to said upstream wall so that the Coand ă effect causes the respective flow stream to retain contact with the upstream wall.

5. A fuel injector according to claim 4, wherein said predetermined angle is at least 70°.

6. A fuel injector according to claim 4, wherein said predetermined angle is at most 85°.

7. A fuel injector according to claim 4, wherein the pressure surface is absent from the second section.

8. A fuel injector according to claim 1, wherein the annular flow passage is a cylindrical annulus.

9. A fuel injector according to claim 1, wherein the annular flow passage is a frustoconical annulus which expands from the fuel distributor slots to the prefilming lip.

10. A fuel injector according to claim 1 which is an airblast fuel injector.

11. A fuel spray nozzle having the fuel injector according to claim 1.

12. A fuel spray nozzle according to claim 11, wherein the fuel injector is a mains fuel injector, the nozzle further comprising a radially inwards pilot fuel injector.

13. A gas turbine engine combustor having the fuel spray nozzle according to claim 11.

14. A fuel injector for a fuel spray nozzle of a gas turbine engine combustor, the fuel injector comprising:

an annular flow passage which conveys fuel to a prefilming lip at a downstream end of the annular flow passage, and a plurality of fuel distributor slots which are circumferentially spaced around and in fluid communication with the upstream end of the annular flow passage to deliver respective fuel streams into the annular flow passage;

wherein the plurality of fuel distributor slots are configured to open onto an upstream wall at the upstream end of the annular flow passage at a swirl angle of at least 80° but not more than 90° from the downstream direction of the central axis of the annular flow passage, and each of the fuel distributor slots further comprises:

a first section in which a pressure surface and an opposing suction surface constrain the respective flow stream to flow at a predetermined angle relative to the axis of the annular flow passage, and a second section in which the suction surface is smoothly continued to said upstream wall so that the Coand ă effect causes the respective flow stream to retain contact with the upstream wall.

15. A fuel injector according to claim 14, wherein the pressure surface and the opposing suction surface of the first section are parallel.

16. A fuel injector for a fuel spray nozzle of a gas turbine engine combustor, the fuel injector comprising:

an annular flow passage which conveys fuel to a prefilming lip at a downstream end of the annular flow passage, and a plurality of fuel distributor slots which are circumferentially spaced around and in fluid communication with the upstream end of the annular flow passage to deliver respective fuel streams into the annular flow passage;

wherein the plurality of fuel distributor slots are configured to open onto an upstream wall at the upstream end of the annular flow passage at a swirl angle of at least 80° but not more than 90° from the downstream direction of the central axis of the annular flow passage, and each slot further comprises:

a first section in which a pressure surface and an opposing suction surface constrain the respective flow stream to flow at a predetermined angle relative to the axis of the annular flow passage, the pressure surface and the opposing suction surface of the first section are parallel, and the length of the first section is between one and three times the slot width in that section, and a second section in which the suction surface is smoothly continued to said upstream wall so that the Coand ăeffect causes the respective flow stream to retain contact with the upstream wall.

17. A fuel injector for a fuel spray nozzle of a gas turbine engine combustor, the fuel injector comprising:

an annular flow passage which conveys fuel to a prefilming lip at a downstream end of the annular flow passage, and a plurality of fuel distributor slots which are circumferentially spaced around and in fluid communication with the upstream end of the annular flow passage to deliver respective fuel streams into the annular flow passage;

wherein the plurality of fuel distributor slots are configured to open onto an upstream wall at the upstream end of the annular flow passage at a swirl angle of at least 80° but not more than 90° from the downstream direction of the central axis of the annular flow passage, and each slot further comprises:

a first section in which a pressure surface and an opposing suction surface constrain the respective flow stream to flow at a predetermined angle relative to the axis of the annular flow passage, and a second section in which the suction surface is smoothly continued to said upstream wall with a radius that starts at least 0.5 slot widths downstream from the end of the pressure surface, so that the Coand ă effect causes the respective flow stream to retain contact with the upstream wall.

* * * * *